US009172150B2

(12) United States Patent
Guenter et al.

(10) Patent No.: US 9,172,150 B2
(45) Date of Patent: Oct. 27, 2015

(54) COMPONENT COMPOSITE BETWEEN TWO COMPONENTS USED FOR CURRENT CONDUCTION AND METHOD FOR MANUFACTURING A COMPONENT COMPOSITE

(71) Applicants: Friedhelm Guenter, Marbach (DE); Reiner Ramsayer, Rutesheim (DE)

(72) Inventors: Friedhelm Guenter, Marbach (DE); Reiner Ramsayer, Rutesheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 16 days.

(21) Appl. No.: 14/086,471

(22) Filed: Nov. 21, 2013

(65) Prior Publication Data

US 2014/0144701 A1 May 29, 2014

(30) Foreign Application Priority Data

Nov. 23, 2012 (DE) ..... 10 2012 221 466

(51) Int. Cl.

| | |
|---|---|
| ***H01R 11/11*** | (2006.01) |
| ***H01R 4/10*** | (2006.01) |
| ***H01R 4/62*** | (2006.01) |

(52) U.S. Cl.

CPC .. *H01R 4/10* (2013.01); *H01R 4/62* (2013.01); *Y10T 29/49117* (2015.01)

(58) Field of Classification Search

CPC ..... H01R 4/62; H01R 4/10; H01R 13/03
USPC ..... 439/883
See application file for complete search history.

(56) References Cited

U.S. PATENT DOCUMENTS

| | | | | |
|---|---|---|---|---|
| 6,077,096 | A * | 6/2000 | Moring et al. | 439/92 |
| 6,407,657 | B1 * | 6/2002 | Oh | 337/197 |
| 7,174,633 | B2 * | 2/2007 | Onuma | 29/854 |
| 8,562,361 | B2 * | 10/2013 | Corbett et al. | 439/100 |
| 2008/0194126 | A1 * | 8/2008 | Grant et al. | 439/108 |
| 2010/0105238 | A1 * | 4/2010 | Good | 439/357 |
| 2011/0207372 | A1 * | 8/2011 | Breen, IV | 439/629 |
| 2013/0210261 | A1 * | 8/2013 | Weber et al. | 439/358 |
| 2013/0323947 | A1 * | 12/2013 | Lee et al. | 439/131 |
| 2014/0329406 | A1 * | 11/2014 | Anderson et al. | 439/521 |

FOREIGN PATENT DOCUMENTS

DE 10 2009 054 476 6/2011

* cited by examiner

*Primary Examiner* — Jean F Duverne
(74) *Attorney, Agent, or Firm* — Kenyon & Kenyon LLP

(57) ABSTRACT

A component composite between two components used for current conduction, having a receptacle opening formed on the first component and a connection section of the second component, which is situated in the receptacle opening, the connection section of the second component being configured to be pin-shaped and a press-fit connection being formed between the receptacle opening and the connection section. In particular, it is provided that the receptacle opening is configured to be a blind hole.

17 Claims, 1 Drawing Sheet

COMPONENT COMPOSITE BETWEEN TWO COMPONENTS USED FOR CURRENT CONDUCTION AND METHOD FOR MANUFACTURING A COMPONENT COMPOSITE

RELATED APPLICATION INFORMATION

The present application claims priority to and the benefit of German patent application no. 10 2012 221 466.6, which was filed in Germany on Nov. 23, 2012, the disclosure of which is incorporated herein by reference.

FIELD OF THE INVENTION

The present invention relates to a component composite. Furthermore, the present invention relates to a method for manufacturing a component composite according to the present invention.

BACKGROUND INFORMATION

Such a component composite between two components used for current conduction is generally discussed in the related art. The first component, which is configured in the form of a contact lug or the like, is equipped with a receptacle opening in the form of a through hole. A pin-shaped connection section of the second component is subsequently inserted into the receptacle opening thus formed, wherein the dimensional tolerances between the diameter of the through hole and the external diameter of the connection section are adapted to one another in such a way that a press-fit connection is formed between the two components. Such a press-fit connection has the advantage that it does not require any additional connecting elements, for example, screws or the like, or any welding between the two components.

In particular in the case of components made of different materials, for example, in the case of a first component which is made of copper and a second component which is made of aluminum, the problem exists that as a result of the different coefficients of thermal expansion, the strength of the press-fit connection between the two components is temperature-dependent. In addition, such unprotected electrical connections between two components are fundamentally corrosion-prone. In the event of occurrence of corrosion in the transition area between the two components, the contact resistance is increased. This undesirable resistance increase may become so high depending on the application that the requirements placed on the connection between the two components are no longer met, and the operation of an electrical appliance or the like is therefore no longer reliably ensured when considered over the service life. In particular in the case of the dissimilar materials discussed (copper and aluminum), the connection is particularly sensitive with respect to corrosion. Such component composites are required, for example, in the electrical contacting of lithium-ion batteries with lines used for current conduction. These connections are particularly susceptible to the attack of corrosive media as a result of the different electrochemical potentials. In particular if the electrolyte in the battery reaches the contact point between the copper and the aluminum, the connection point tends very strongly toward corrosion.

In addition, a method for electrical contacting of a battery cell, in which a connecting element has a ring-shaped element, which is introduced into a ring-shaped recess of the connecting element with the aid of a press-fit, is discussed in DE 10 2009 054 476 A1. Upon the connection of a pin-shaped pole of the battery to the connecting element, the pole penetrates the ring-shaped element, which is made of the same material as the pole. In addition, the connection point (in which no press-fit connection is provided) is equipped with a welded joint. In the case of this approach, the immediate connection area between the pole of the battery and the ring-shaped element tends to be less susceptible to corrosion because both areas are made of the same material, but the connecting element itself is relatively complexly configured. In addition, in all component composites in which the receptacle opening is configured in the form of a through opening or a through hole, it is problematic that aggressive media may enter the connection area between the two components from both sides of the through opening, for example.

SUMMARY OF THE INVENTION

Proceeding from the described related art, the present invention is based on the object of refining a component composite between two components used for current conduction according to the definition of the species in claim 1 in such a way that it offers increased corrosion protection in a structurally simple way. This object is achieved according to the present invention in a component composite having the features described herein in that the receptacle opening in the first component is configured in the form of a blind hole. Such a configuration of the receptacle opening has the advantage that the entry of aggressive media, for example, which result in corrosion, is only possible from one side of the connection between the two components, specifically from the side from which the second component is inserted with its connection section into the receptacle opening of the first component. However, even if corrosion is already present in this area, the possibility exists that there is no corrosion in the area of the blind hole base between the two components, for example, so that the contact resistance between the two components is only increased by a relatively small amount.

The component composite according to the present invention is advantageously usable anywhere electrical connections may be implemented by a simple, cost-effective press-fitting procedure. Such fields of use primarily exist in high-power contacts in the field of electrical engineering/electronics, in battery contacts of lithium ion cells, and in general in connections between components made of aluminum and copper in corrosive surroundings.

Advantageous refinements of the component composite according to the present invention are set forth in the further descriptions herein.

An approach of the component composite is in the use of components made of different metallic materials having different coefficients of thermal expansion.

Since the temperature often rises during the operation of a machine or a device, also in the connection area between the two components of the component composite, it is desirable if elevated temperatures on the component composite also do not result in worsening of the connection or the contact resistance between the two components. Therefore, in an advantageous embodiment of the present invention, it is provided that the first component is made of a material which has a lower coefficient of thermal expansion than the second component. Such a configuration has the result that the connection section of the second component, which is inserted into the receptacle opening of the first component, expands more strongly in the event of a temperature increase than the diameter of the receptacle opening, so that in the event of a temperature increase, an increased contact pressure force is achieved between the two components in the connection area, which tends to result in a reduction of the electrical contact resistance and in any case prevents the connection between the components from loosening.

To prevent or make difficult the entry of media, in particular aggressive media, which causes the corrosion in the connection area between the components, it is provided in another embodiment of the present invention that an area of the second component, which has a larger cross-sectional area than the cross section of the connection section, adjoins the connection section on the side facing away from the receptacle opening via a shoulder, and the second component rests with its shoulder on the top side of the first component and overlaps the edge area on the first component delimiting the receptacle opening. At the same time, the shoulder may also be used for the purpose, during the manufacturing of the connection, of defining the required press-fitting depth of the connection section into the receptacle opening, so that if necessary the assembly process may be carried out particularly simply and securely.

A further improvement of the corrosion resistance of the connection area in the last-described configuration is achieved if a sealant is situated between the top side of the first component and the second component, in particular in the area of the shoulder. Such a sealant is to prevent in particular infiltration of the connection area by aggressive media.

In particular in the case of geometries or components in which the formation of the press-fit connection between the two components is critical, it may be desirable to additionally secure the press-fit connection or to reduce the tensions prevailing in the components during the configuration of a correct press-fit connection. Therefore, in another embodiment of the component composite, it is provided that the receptacle opening has an area which is enlarged in the longitudinal direction of the receptacle opening when viewed in cross section, in particular in the form of a radial peripheral undercut, and an end area of the connection section is situated in the area to form a form-fit connection between the two components. In other words, this means that the connection between the two components of the component composite additionally has a form-fit connection in addition to the press-fit connection. This is of particularly great significance in particular for the connection between the two components if, as a result of particularly large differences in the coefficients of thermal expansion of the two components, for example, the existing press-in force between the two components changes strongly via the temperature.

To be able to form the form-fit connection in the simplest possible way during the connection of the two components, it is provided in a specific embodiment of the form-fit connection that the area which is enlarged in cross section is situated in the area of the base of the receptacle opening, and a protrusion, which may be situated in the longitudinal axis of the receptacle opening, originates from the base, this protrusion being situated in operational connection to the end area of the connection section facing toward the base. Such a configuration allows, when an axial press-in force is applied to the second component, for the end area of the second component to be deformed particularly simply due to the protrusion and to be displaced radially outward into the area of the area (undercut) which is enlarged in cross section. The mechanical stress of the second component during the formation of the form-fit connection is thus reduced in particular.

A still further reduced mechanical stress of the second component during the formation of the form-fit connection and targeted guiding of the end area of the second component in the area of the base of the receptacle opening may be achieved if a centering depression which is aligned with the (pointed) protrusion is formed in the front end of the connection section.

To reduce the press-in forces during the press-fitting of the second component into the first component, on the one hand, and optionally to achieve an increased corrosion protection effect, on the other hand, it is provided in another embodiment that an auxiliary material, in particular in the form of a lubricant and/or a corrosion protection agent, is situated between the receptacle opening and the connection section.

The component composite thus described may be formed particularly simply by applying a press-in force to the second component. An additional improvement of the connection between the two components may be achieved, however, if the press-fitting of the connection section of the second component into the receptacle opening of the first component is carried out with the aid of an ultrasonic joining device. The use of such a device has the advantage that in addition to the force-fit connection as a result of the press-fit connection and optionally the form-fit connection between the two components in the contact area, an additional integrally joined portion results between the two components. In addition, the introduced ultrasound causes surface residues which possibly adhere to the components to be removed and oxide layers to be broken through. In addition, the joining force during the press-fitting is reduced by the ultrasound influence.

Further features, advantages, and details of the present invention result from the following description of exemplary embodiments and on the basis of the drawings.

DETAILED DESCRIPTION

Figure 1:
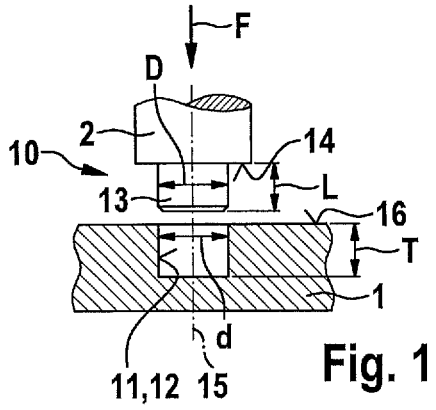
FIG. 1 shows a first component composite according to the present invention in a side view in partial section before the formation of a press-fit connection between the two components participating in the component composite.

Identical elements or elements with identical functions are provided with identical reference numerals in the figures.

FIG. 1 shows a first component composite 10 according to the present invention between two components 1, 2, which are used for current conduction. In particular, it may be provided that the two metallic components 1, 2 are made of different materials and have different coefficients of thermal expansion. For the case of different coefficients of thermal expansion, it may be provided that component 1 has a lesser coefficient of thermal expansion than component 2. For example, component 1 is made of copper and component 2 is made of aluminum.

It is essential to the present invention that a receptacle opening 11 in the form of a blind hole 12 is formed in first component 1. Diameter d of blind hole 12 is less than diameter D of a pin-shaped connection section 13 of second component 2, which is insertable into blind hole 12. The two diameters d, D are adapted to one another in such a way that a press-fit connection is formed between components 1, 2 in the area of connection section 13 after the connection of the two components 1, 2.

Second component 2 additionally has a radial peripheral shoulder 14, so that the diameter of component 2 above connection section 13, i.e., on the side facing away from blind hole 12, is greater than diameter d of blind hole 12. Length L of (pin-shaped) connection section 13 corresponds at most to depth T of blind hole 12.

The press-fitting of connection section 13 into blind hole 12 is carried out by applying a force F, whose action line extends in the direction of longitudinal axis 15 of connection section 13 or of blind hole 12. Such a force F may be produced by a press-in device (not shown). Alternatively, however, it is also conceivable that the required press-in force is produced by an ultrasonic joining device, which is also situated operationally connected at least to component 2 in the direction of force F. The press-fitting of connection section 13 of second component 2 into blind hole 12 of first component 1 is carried out until shoulder 14 rests with its front end facing toward first component 1 on top side 16 of first component 1. In this state, shoulder 14 overlaps the area of blind hole 12 radially adjoining blind hole 12 and therefore in particular prevents the entry of media into the area of blind hole 12.

Figure 2:
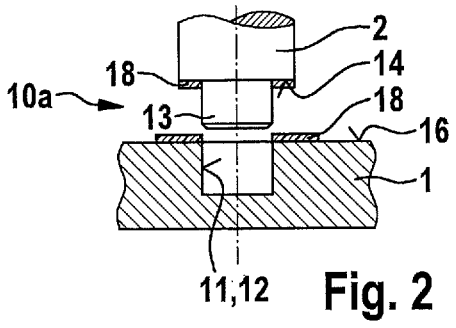
FIG. 2 shows a component composite modified in relation to FIG. 1, also in a side view in partial section.

Component composite 10*a* shown in FIG. 2 differs from component composite 10 in that a sealant 18 is situated on the front end of shoulder 14 facing toward first component 1 and/or on top side 16 of first component 1 facing toward shoulder 14. Sealant 18 additionally seals the area between top side 16 of first component 1 and shoulder 14 of second component 2 when connection section 13 is press-fitted and therefore prevents the entry of media into blind hole 12. Additionally or alternatively, it may be provided that an auxiliary material, in particular in the form of a lubricant and/or a corrosion protection agent, is situated between receptacle opening 11 and connection section 13.

Figure 3:
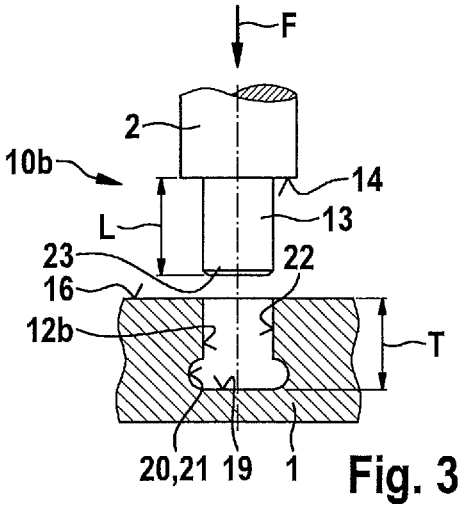
FIG. 3 shows another specific embodiment of the present invention, in which the component composite is equipped on a first component with an undercut to form a form-fit connection, in a side view in partial section.

Component composite 10*b* shown in FIG. 3 has in the area of base 19 of blind hole 12*b* an area, which is enlarged in cross section, in the form of a radial peripheral ring groove 20, which forms an undercut 21. The cross-sectional area of blind hole 12*b* in the area of base 19 therefore has a cross-sectional area which is greater than the cross-sectional area in cylindrical area 22 of blind hole 12*b*, which adjoins ring groove 20 in the direction toward top side 16 of component 1. Furthermore, length L of connection section 13, if a shoulder 14 is used, is greater than depth T of blind hole 12*b*. In this way, if a sufficiently large force F is applied during the press-fitting of connection section 13 into blind hole 12*b*, end area 23 of connection section 13 facing toward base 19 is plastically deformed and fills up the area of ring groove 20. As a consequence, in addition to the described press-fit connection, an additional form-fit connection is formed between the two components 1, 2.

Figure 4:
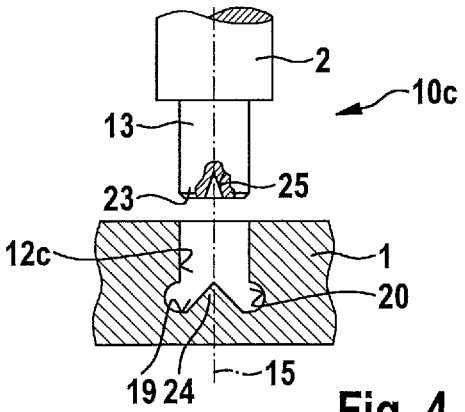
FIG. 4 shows a component composite modified in relation to FIG. 3 before the formation of the connection between the two components.
Figure 5:
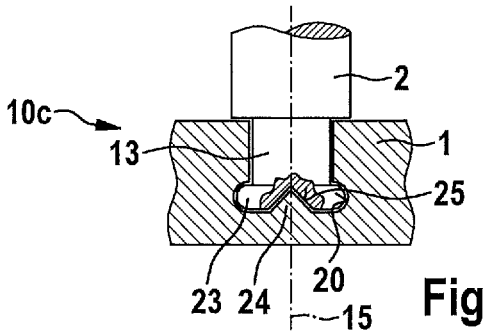
FIG. 5 shows a component composite modified in relation to FIG. 3 after the formation of the connection between the two components.

Finally, FIGS. 4 and 5 show a component composite 10*c* modified once again in relation to FIG. 3. Component composite 10*c* includes, on base 19 of blind hole 12*c*, a protrusion 24 extending from base 19 in the form of a mandrel or a cone, which interacts with a centering depression 25 formed in the front end of end area 23 of second component 2, protrusion 24 and centering depression 25 being situated in alignment with longitudinal axis 15. According to the illustration of FIG. 5, protrusion 24 causes, in cooperation with centering depression 25, radial centering or guiding of connection section 13 and radial displacement of the material of end area 23 of connection section 13, so that it fills up ring groove 20 as completely as possible.

Component composites 10, 10*a* through 10*c* thus described may be altered or modified in manifold ways, without deviating from the idea of the present invention. In particular, the shape of connection section 13 and receptacle opening 11 is not restricted to round cross sections, but rather these may have any arbitrary cross section. It is only essential that a press-fit connection is formed between components 1, 2.

What is claimed is:

1. A component composite between two components used for current conduction, comprising:

a receptacle opening formed on the first component;

a connection section of the second component, which is situated in the receptacle opening, the connection section of the second component being pin-shaped; and a press-fit connection being formed between the receptacle opening and the connection section, wherein the receptacle opening is a blind hole, and wherein the second component completely fills a cross-sectional area of the receptacle opening.

2. The component composite of claim 1, wherein the two components are made of different metallic materials having different coefficients of thermal expansion.

3. The component composite of claim 2, wherein the first component is made of a material which has a lower coefficient of thermal expansion than the second component.

4. The component composite of claim 1, wherein an auxiliary material, in the form of at least one of a lubricant and a corrosion protection agent, is situated between the receptacle opening and the connection section.

5. A component composite between two components used for current conduction, comprising:

a receptacle opening formed on the first component;

a connection section of the second component, which is situated in the receptacle opening, the connection section of the second component being pin-shaped; and a press-fit connection being formed between the receptacle opening and the connection section, wherein the receptacle opening is a blind hole, and wherein an area of the second component, which has a larger cross-sectional area than the cross section of the connection section, adjoins the connection section on the side facing away from the receptacle opening via a shoulder, and the second component rests with its shoulder on the top side of the first component and overlaps the edge area delimiting the receptacle opening on the first component.

6. The component composite of claim 5, wherein a sealant is situated between the top side of the first component and the second component, in the area of the shoulder.

7. The component composite of claim 5, wherein the two components are made of different metallic materials having different coefficients of thermal expansion.

8. The component composite of claim 7, wherein the first component is made of a material which has a lower coefficient of thermal expansion than the second component.

9. The component composite of claim 5, wherein the receptacle opening, viewed in the longitudinal direction of the receptacle opening, has an area enlarged in cross section, in the form of a radial peripheral undercut, and an end area of the connection section is situated in the area enlarged in cross section to form a form-fit connection between the two components.

10. The component composite of claim 9, wherein the area enlarged in cross section is situated in the area of the base of the receptacle opening, and a protrusion, which is situatable in the longitudinal axis of the receptacle opening, originates from the base, the protrusion being situated operationally connected to the end area of the connection section facing toward the base.

11. The component composite of claim 10, wherein a centering depression, which is aligned with the protrusion, is formed in the front end of the end area of the connection section.

12. A component composite between two components used for current conduction, comprising:

a receptacle opening formed on the first component;

a connection section of the second component, which is situated in the receptacle opening, the connection section of the second component being pin-shaped; and a press-fit connection being formed between the receptacle opening and the connection section, wherein the receptacle opening is a blind hole, and wherein the receptacle opening, viewed in the longitudinal direction of the receptacle opening, has an area enlarged in cross section, in the form of a radial peripheral undercut, and an end area of the connection section is situated in the area enlarged in cross section to form a form-fit connection between the two components.

13. The component composite of claim 12, wherein the area enlarged in cross section is situated in the area of the base of the receptacle opening, and a protrusion, which is situatable in the longitudinal axis of the receptacle opening, originates from the base, the protrusion being situated operationally connected to the end area of the connection section facing toward the base.

14. The component composite of claim 13, wherein a centering depression, which is aligned with the protrusion, is formed in the front end of the end area of the connection section.

15. A method for manufacturing a component composite, the method comprising:

providing a component composite between two components used for current conduction, including a receptacle opening formed on the first component, and a connection section of the second component, which is situated in the receptacle opening, the connection section of the second component being pin-shaped; and press-fitting the connection section of the second component into the receptacle opening of the first component with the aid of an ultrasonic joining device, such that the second component completely fills a cross-sectional area of the receptacle opening.

16. The method of claim 15, further comprising:

providing the second component with an area which has a larger cross-sectional area than the cross section of the connection section, and which adjoins the connection section on the side facing away from the receptacle opening via a shoulder, such that the second component rests with its shoulder on the top side of the first component and overlaps the edge area delimiting the receptacle opening on the first component.

17. The method of claim 15, further comprising:

providing a radial peripheral undercut in the receptacle opening, wherein the undercut has an area enlarged in cross section when the receptacle opening is viewed in the longitudinal direction; and providing an end area of the connection section such that the end area is situated in the area enlarged in cross section to form a form-fit connection between the two components.

* * * * *